US010392170B2

(12) United States Patent
Yasumi

(10) Patent No.: US 10,392,170 B2
(45) Date of Patent: Aug. 27, 2019

(54) CONTAINER CAP

(71) Applicant: TOKIWA Corporation, Gifu (JP)

(72) Inventor: Risa Yasumi, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 183 days.

(21) Appl. No.: 15/281,244

(22) Filed: Sep. 30, 2016

(65) Prior Publication Data

US 2017/0101235 A1 Apr. 13, 2017

(30) Foreign Application Priority Data

Oct. 13, 2015 (JP) ..... 2015-201964

(51) Int. Cl.

| | |
|---|---|
| ***B65D 51/28*** | (2006.01) |
| ***B65D 41/02*** | (2006.01) |
| ***A45D 34/04*** | (2006.01) |
| *A45D 34/00* | (2006.01) |

(52) U.S. Cl.

CPC ..... *B65D 51/28* (2013.01); *A45D 34/042* (2013.01); *B65D 41/02* (2013.01); *A45D 34/00* (2013.01); *A45D 2200/1072* (2013.01)

(58) Field of Classification Search

CPC ..... B65D 51/28; B65D 41/02; A45D 34/042; A45D 34/045; A45D 34/00; A45D 2200/1072; B43K 5/165; B43K 23/12; B43K 23/10; B43K 23/08; B43K 23/122; B43K 23/124; B43K 23/126; B43K 23/128

USPC .... 220/521; 401/269, 61, 98, 102, 124, 202, 401/262

See application file for complete search history.

(56) References Cited

U.S. PATENT DOCUMENTS 5,203,637 A * 4/1993 Nishimura ..... B29C 33/0033 401/202

FOREIGN PATENT DOCUMENTS

| | | | |
|---|---|---|---|
| JP | 10272012 | A | 10/1998 |
| JP | 2007007146 | A | 1/2007 |

* cited by examiner

*Primary Examiner* — Andrew D Perreault

(74) *Attorney, Agent, or Firm* — Isshiki International Law Office; Joseph P. Farrar, Esq.

(57) ABSTRACT

When the temperature of an external environment is decreased, for example, a heat radiating portion 12*a* whose surface area is increased by convex portions 12*b* and 12*c* provided on the external surface of a cap body 12 actively radiates heat of the external surface of the cap body 12 and thus promotes cooling. Consequently, condensation forms on the inner surface of the cap body 12 before condensation forms on the external surface of a container covered by the cap body 12. The condensed drops are trapped, by surface tension, in a concave portion 12*d* of a liquid trapping portion 12*k* provided on the inner surface of the cap body 12. The drops can be prevented from adhering to the external surface of the container covered by the cap body 12.

8 Claims, 15 Drawing Sheets

CONTAINER CAP

CROSS-REFERENCE TO RELATED APPLICATION

The present application is based on and claims priority pursuant to 35 U.S.C. § 119 to Japanese Patent Application No. 2015-201964, filed on Oct. 13, 2015, the entire disclosure of which is hereby incorporated herein by reference.

BACKGROUND

The present disclosure relates to a container cap for closing a container having contents.

In related art, when a cosmetic material container containing a liquid cosmetic material including a volatile component is closed by a container cap, the volatile component evaporates in a space between the cosmetic material container and the container cap, and the evaporated volatile component may be condensed due to the effect of a decrease in the temperature of an external environment or the like. The following Patent Documents 1 and 2 disclose structures for preventing drops condensed and adhering to a container cap from dripping down.

In Patent Document 1, radial or concentric grooves are provided to a curved concave surface of an inner surface of a cap body of a compact container, and condensation is collected in the grooves and drained to a periphery while prevented from dripping. In Patent Document 2, a plurality of concave and convex portions are provided to the inner surface of a bottom portion of a bottomed tubular cap (cap body) for an application container provided with a comb, and condensation is retained in the concave portions and prevented from dripping.

PRIOR ART DOCUMENT

Patent Documents

[Patent Document 1]
Japanese Patent Laid-Open No. 1998-272012
[Patent Document 2]
Japanese Patent Laid-Open No. 2007-007146

BRIEF SUMMARY

The condensation may form not only in the container cap but also on the external surface of the container covered by the container cap. Such drops adhering to the external surface of the container tend to be conspicuous to the eyes of a user and touch a hand easily, as compared with drops on the inner surface of the container cap. Thus, aesthetic appearance is impaired, and the hand of the user is soiled.

It is accordingly an object of the present disclosure to provide a container cap that can prevent drops from adhering to the external surface of a container.

According to the present disclosure, there is provided a container cap fitted to a container having contents, the container cap including a cap body configured to close the container by covering a part of the container, the cap body including: a liquid trapping portion including a concave portion disposed on an inner surface of the cap body, the inner surface being a surface on a side covering the container; and a heat radiating portion including a convex portion disposed on an external surface of the cap body.

According to such a container cap, when the temperature of an external environment is decreased, for example, the heat radiating portion whose surface area is increased by the convex portion disposed on the external surface of the cap body actively radiates heat of the external surface of the cap body, and thus promotes cooling. Consequently, condensation forms on the inner surface of the cap body before condensation forms on the external surface of the container covered by the cap body. The condensed drops are trapped, by surface tension, in the concave portion of the liquid trapping portion disposed on the inner surface of the cap body. Hence, the drops can be prevented from adhering to the external surface of the container. As a result, aesthetic appearance is not impaired, nor is the hand of a user soiled.

When the cap body forms a bottomed tubular shape, and has the liquid trapping portion on an inner circumferential surface of the cap body and has the heat radiating portion on an outer circumferential surface of the cap body, the heat radiating portion provided on the wide region of the outer circumferential surface promotes heat radiation and cooling more, and the liquid trapping portion provided on the wide region of the inner circumferential surface traps the condensed drops more surely.

In addition, when width of the concave portion of the liquid trapping portion is decreased from a rear end side to a front end side, the drops trapped by the concave portion are collected easily and retained surely on the narrow front end side of the concave portion due to capillarity.

In addition, when the container cap further includes a housing cylinder housing the cap body of the bottomed tubular shape together with the convex portion of the heat radiating portion, the cap body is housed in the housing cylinder, and thus the convex portion on the external surface of the cap body is not obstructive, so that the user can easily hold the container cap without any difficulty.

In addition, when the convex portion includes a plurality of convex portions provided along a circumferential direction, a space extending in an axial direction is formed as a flow passage between an inner circumferential surface of the housing cylinder and a part between the convex portions on the outer circumferential surface of the cap body, and a rear end of the flow passage is opened and the flow passage communicates with an external atmosphere, the air of the external atmosphere flows through the flow passage in the axial direction. As a result, the heat radiation by the heat radiating portion is further promoted.

Specific examples of the convex portion suitably producing the above-described action include a plurality of convex portions extending in an axial direction and juxtaposed to each other along a circumferential direction. Such convex portions can suitably radiate heat, and are easy to mold by a die.

In addition, the convex portion may be disposed so as to extend in a circumferential direction, a space extending in an axial direction may be formed as a flow passage between an inner circumferential surface of the housing cylinder and a part between ends in the circumferential direction of the convex portion on the outer circumferential surface of the cap body, and a rear end of the flow passage may be opened and the flow passage may communicate with an external atmosphere. Even in such a constitution, the air of the external atmosphere flows through the flow passage in the axial direction. As a result, the heat radiation by the heat radiating portion is further promoted.

Advantageous Effects

Thus, according to the present disclosure, drops can be prevented from adhering to the external surface of the container, so that aesthetic appearance is not impaired, nor is the hand of a user soiled.

DETAILED DESCRIPTION

Preferred embodiments of a container cap according to the present disclosure will hereinafter be described with reference to FIGS. 1 to 15. FIGS. 1 to 11 show a first embodiment of the present disclosure. FIGS. 12 to 15 show a second embodiment of the present disclosure. In the figures, identical elements are identified by the same reference symbols, and repeated description thereof will be omitted.

The first embodiment shown in FIGS. 1 to 11 will first be described.

Figure 1:
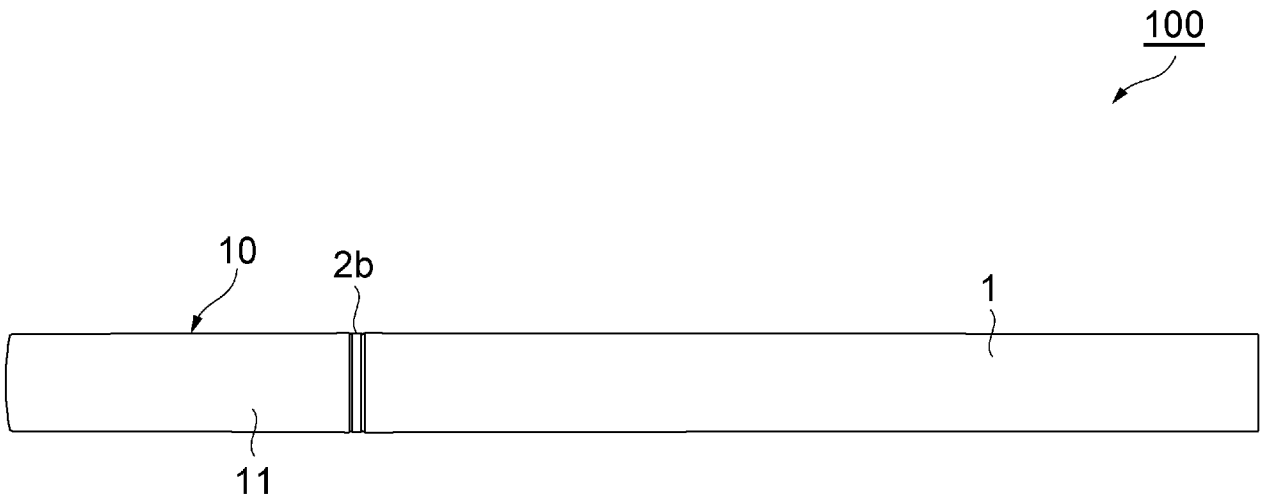
FIG. 1 is an external view showing a liquid cosmetic material container provided with a container cap according to a first embodiment of the present disclosure.
Figure 2:
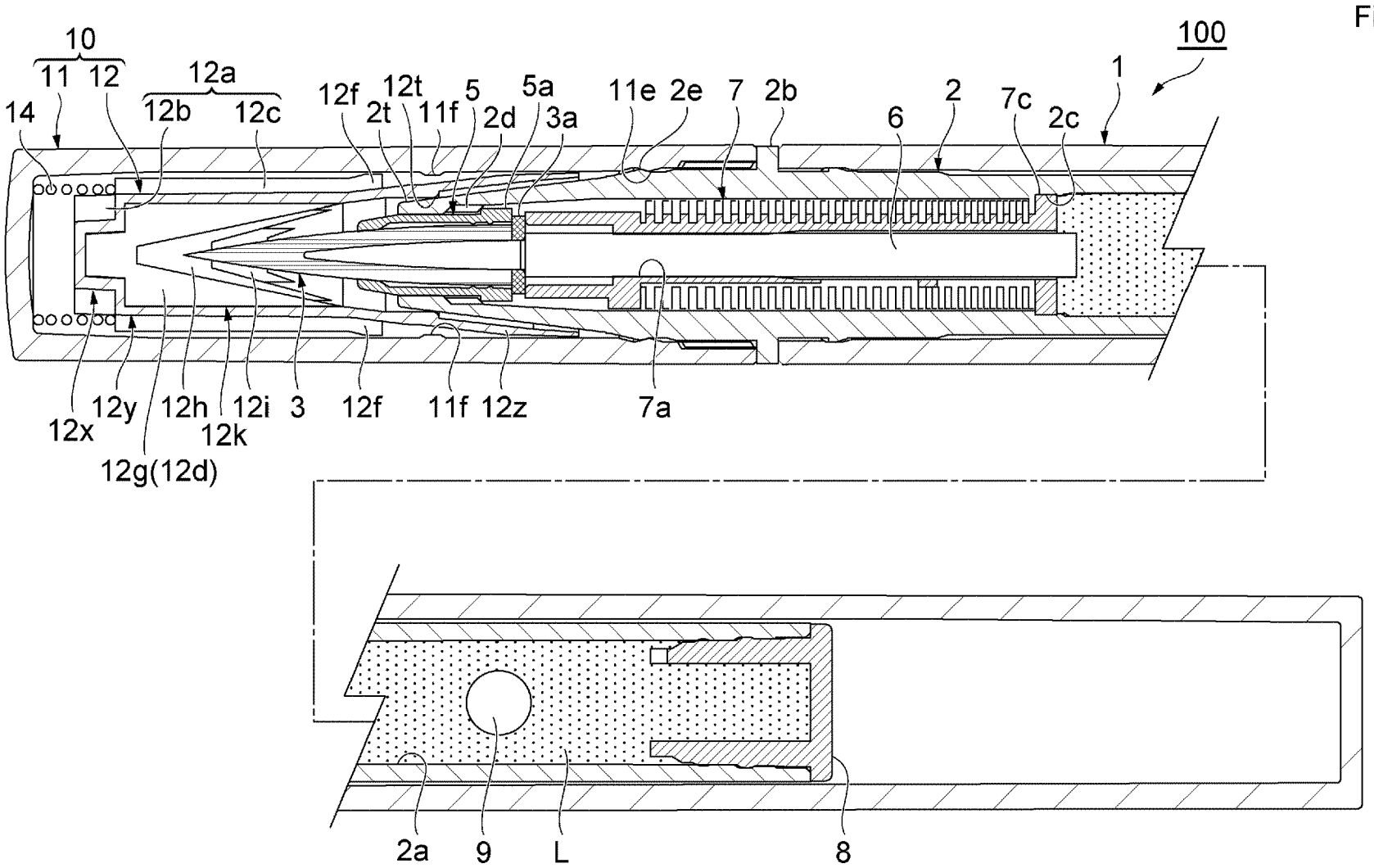
FIG. 2 is a longitudinal sectional view of the liquid cosmetic material container shown in FIG. 1.
Figure 3:
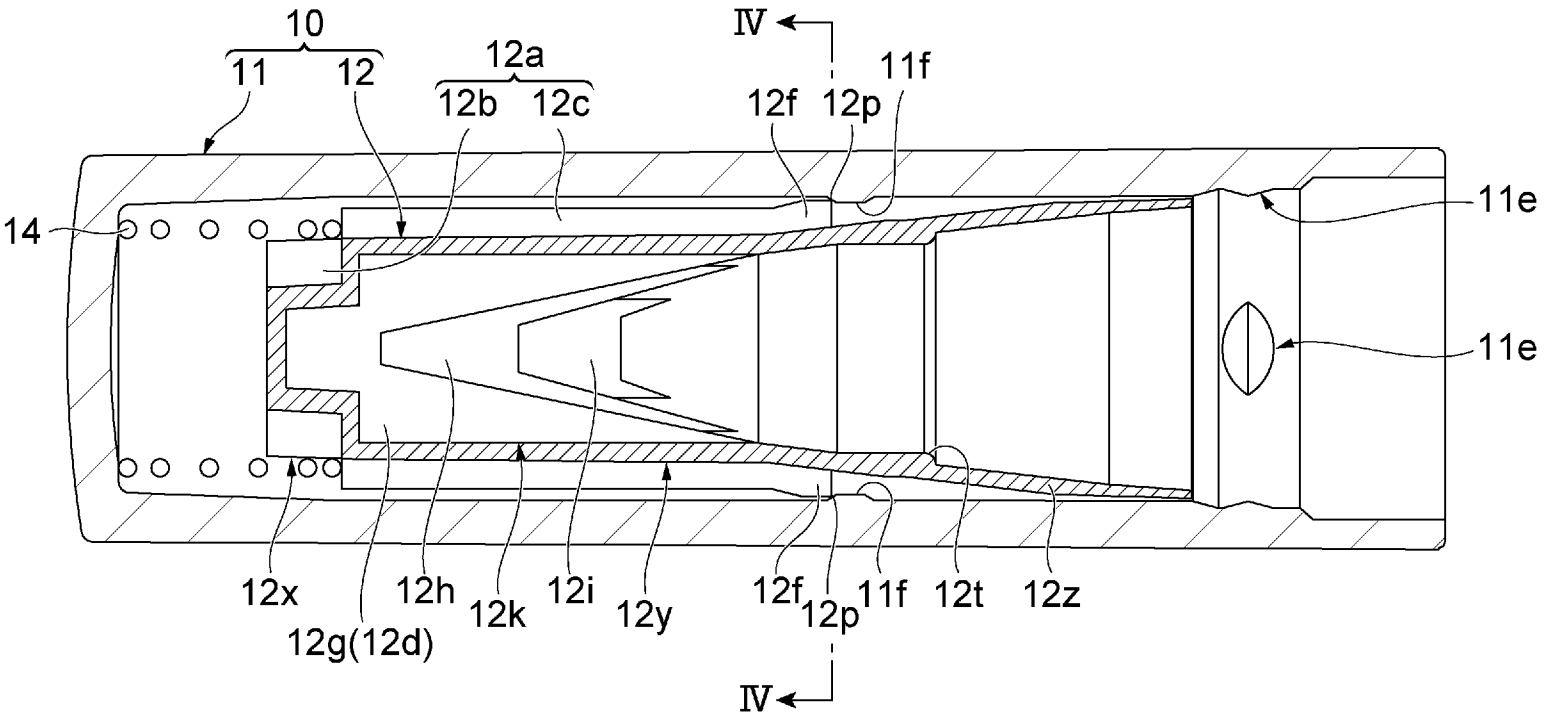
FIG. 3 is a longitudinal sectional view of the container cap removed from the liquid cosmetic material container shown in FIG. 2.
Figure 4:
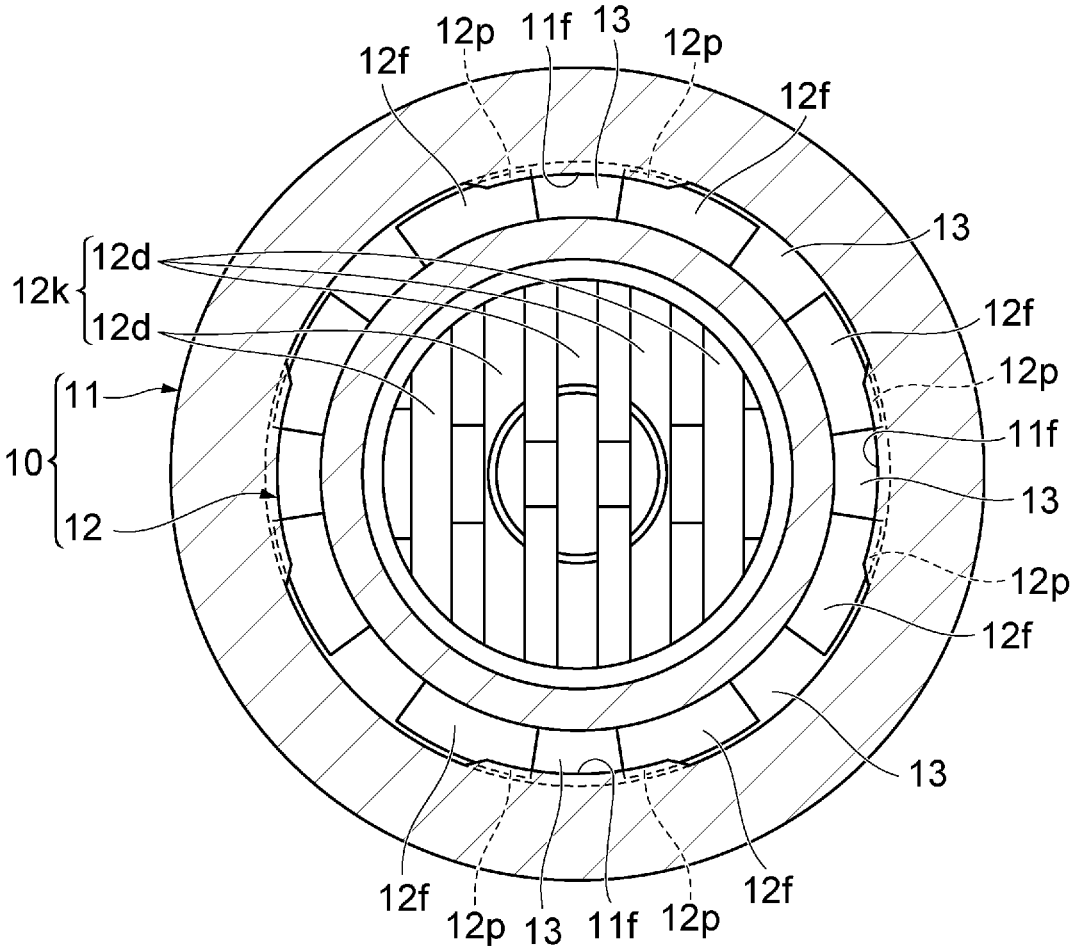
FIG. 4 is a view taken along a line IV-IV of FIG. 3 in the direction of the arrows.
Figure 5:
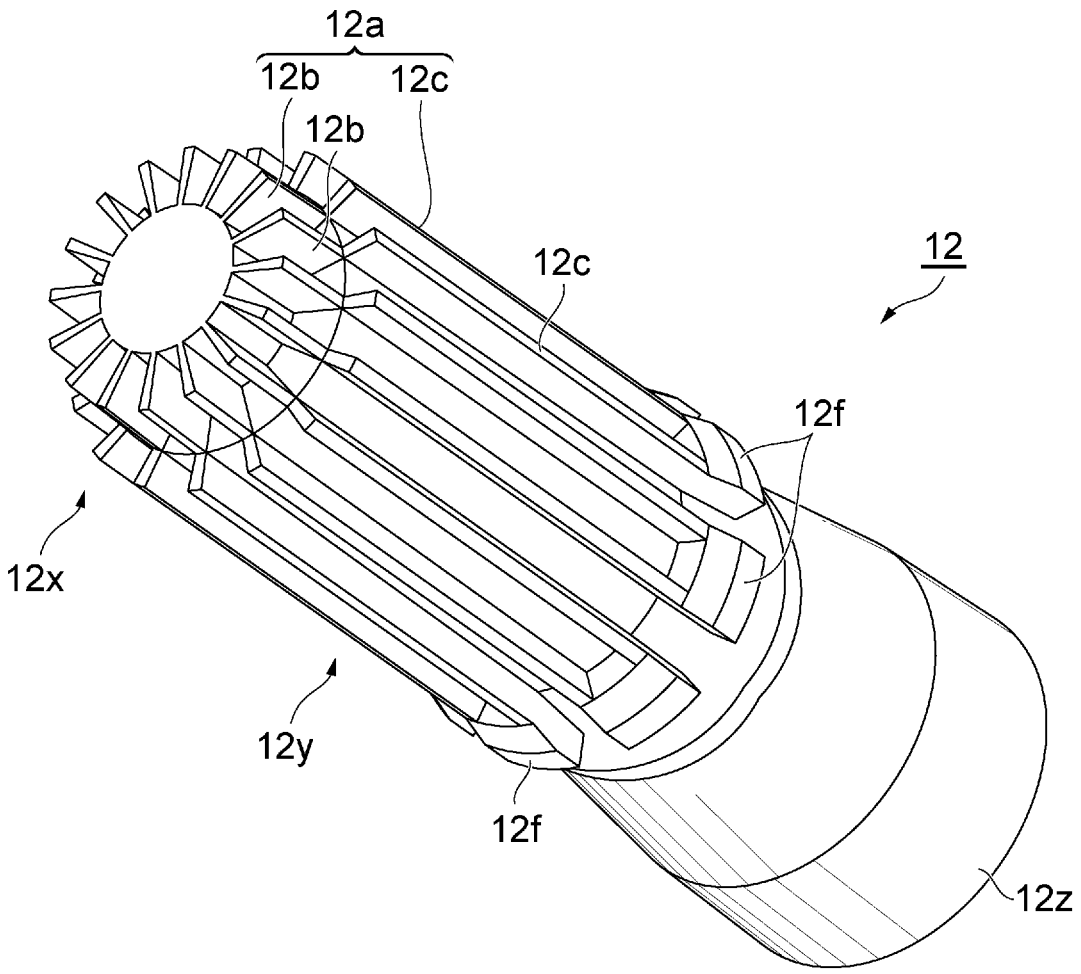
FIG. 5 is a front perspective view of an inner cap in FIG. 3 and FIG. 4.
Figure 6:
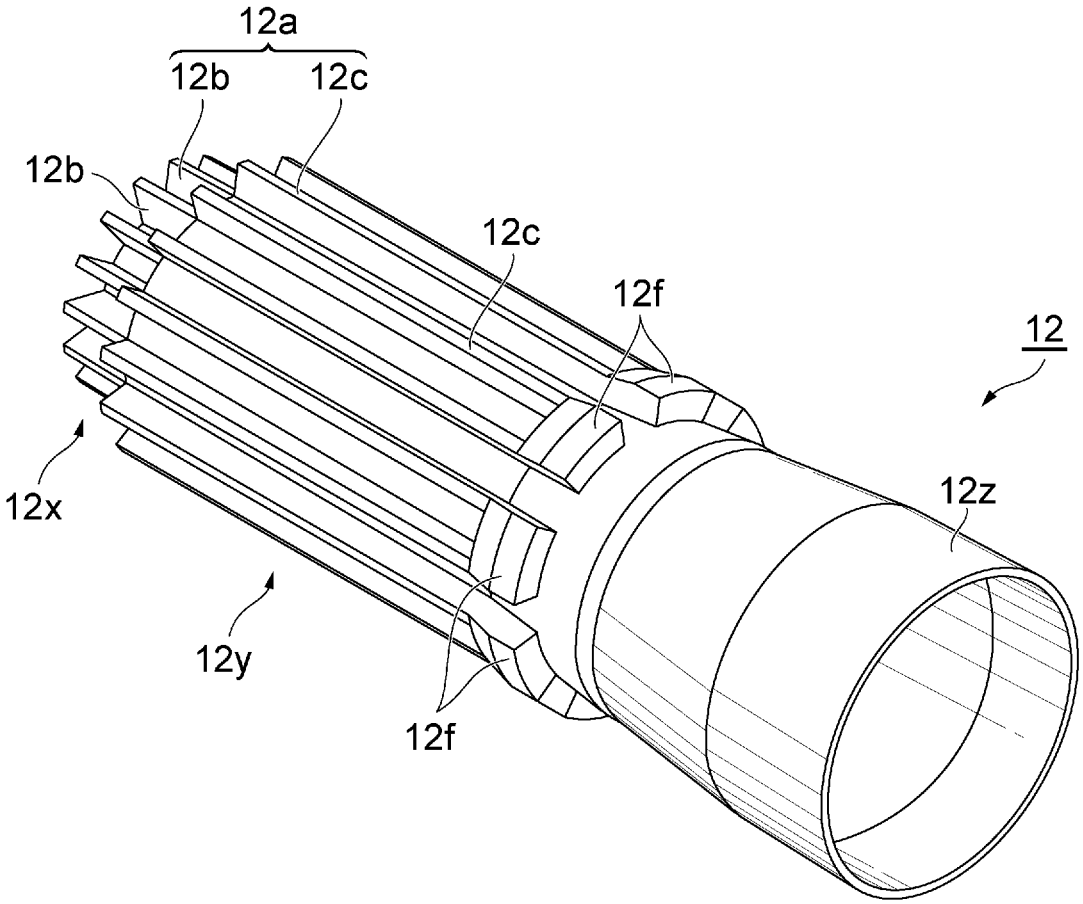
FIG. 6 is a rear perspective view of the inner cap shown in FIG. 5.
Figure 7:
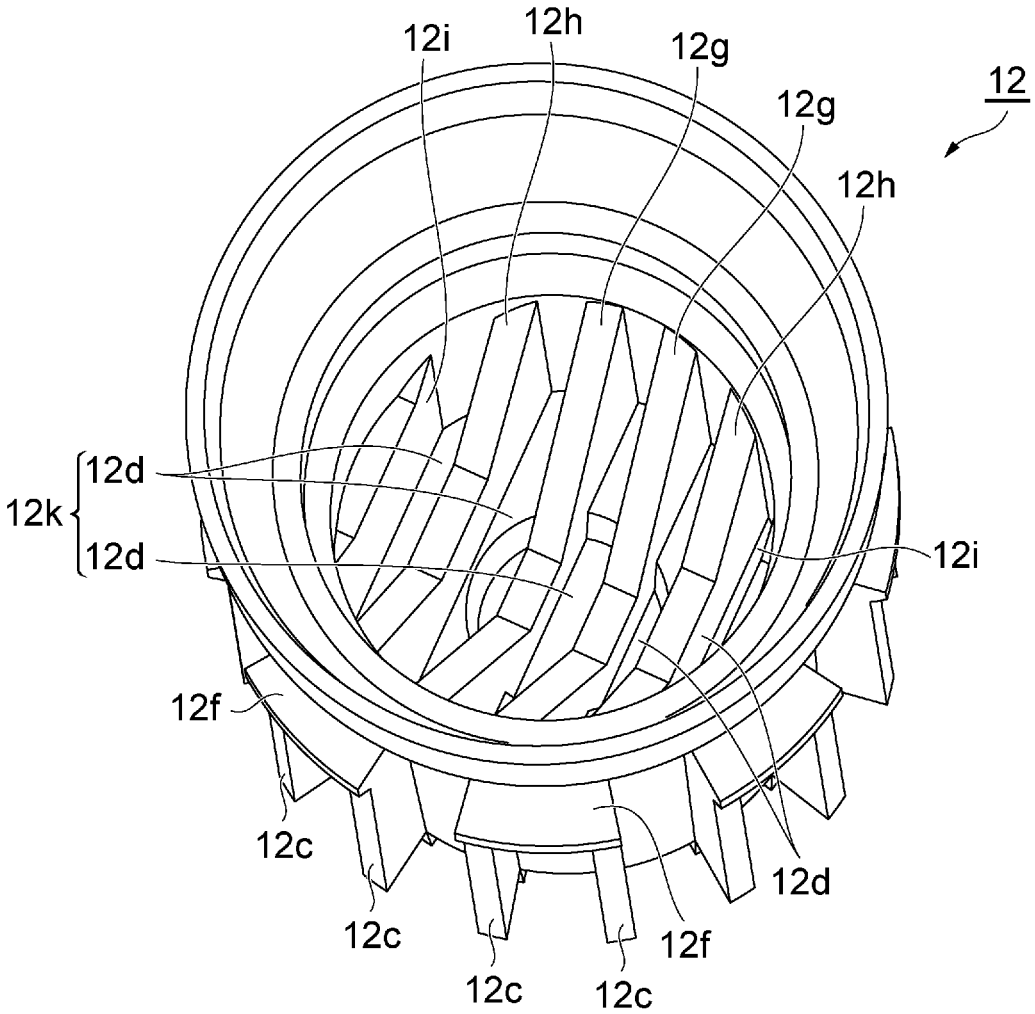
FIG. 7 is a rear perspective view of the inner cap shown in FIG. 6, as viewed from a position closer to an axis.
Figure 8:
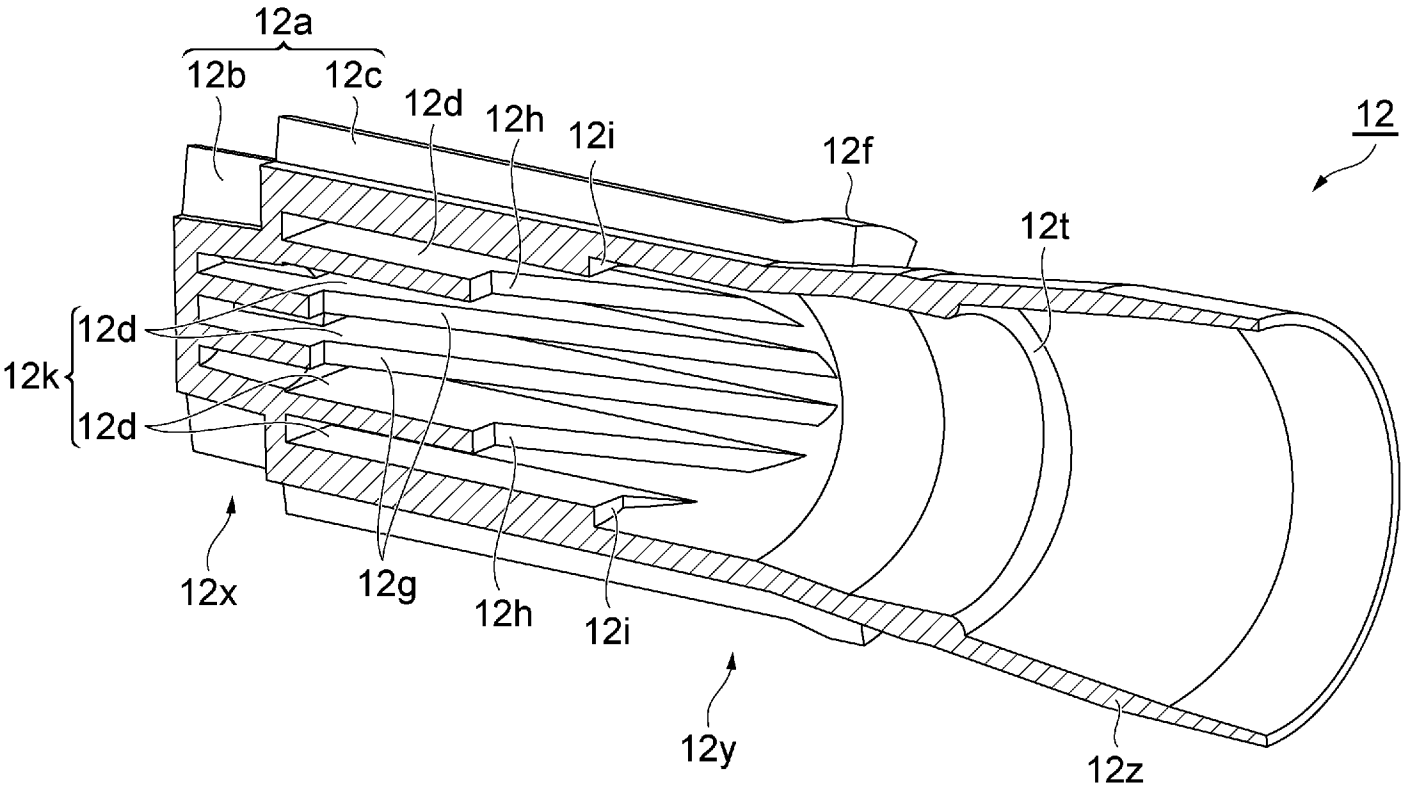
FIG. 8 is a sectional perspective view of the inner cap shown in FIG. 6.
Figure 9:
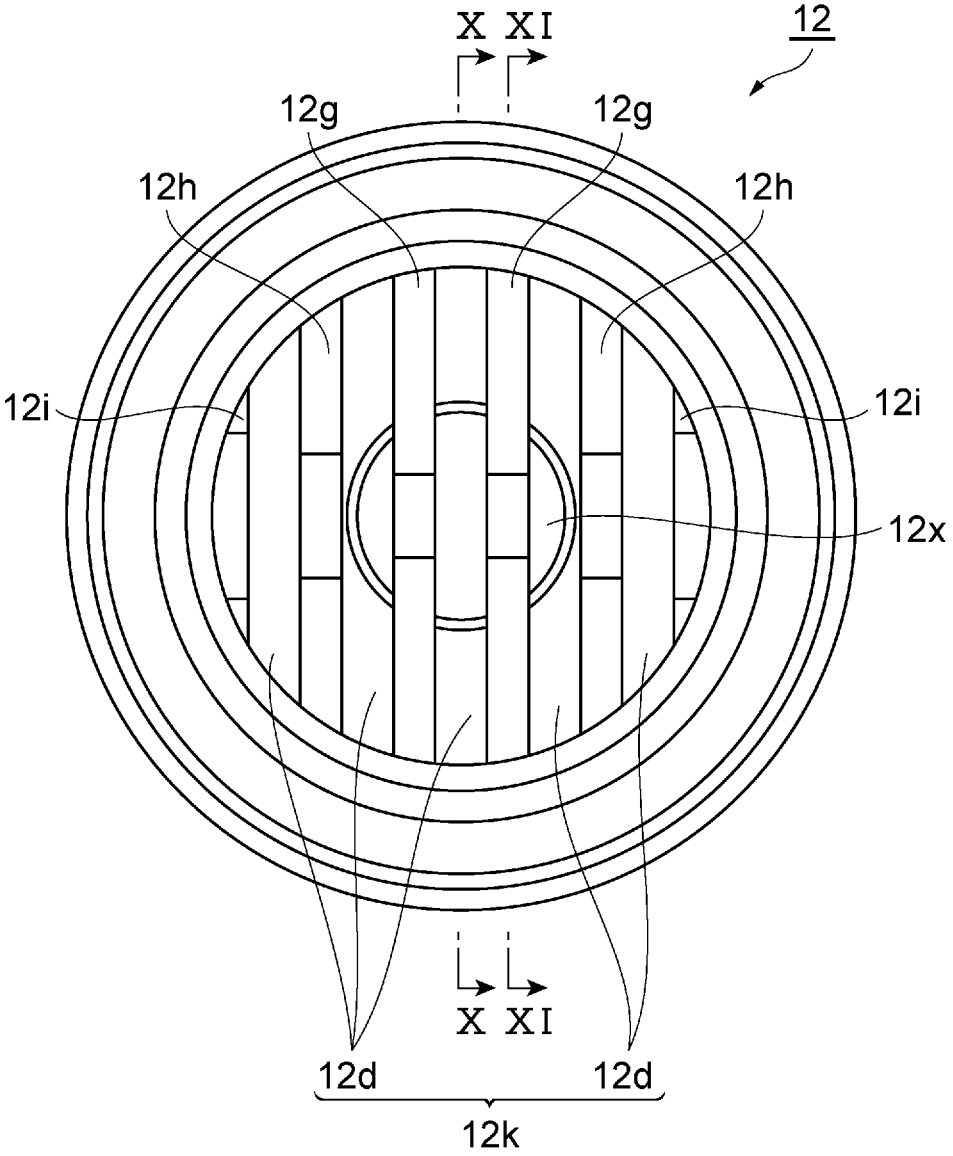
FIG. 9 is a rear view of the inner cap shown in FIGS. 5 to 8.
Figure 10:
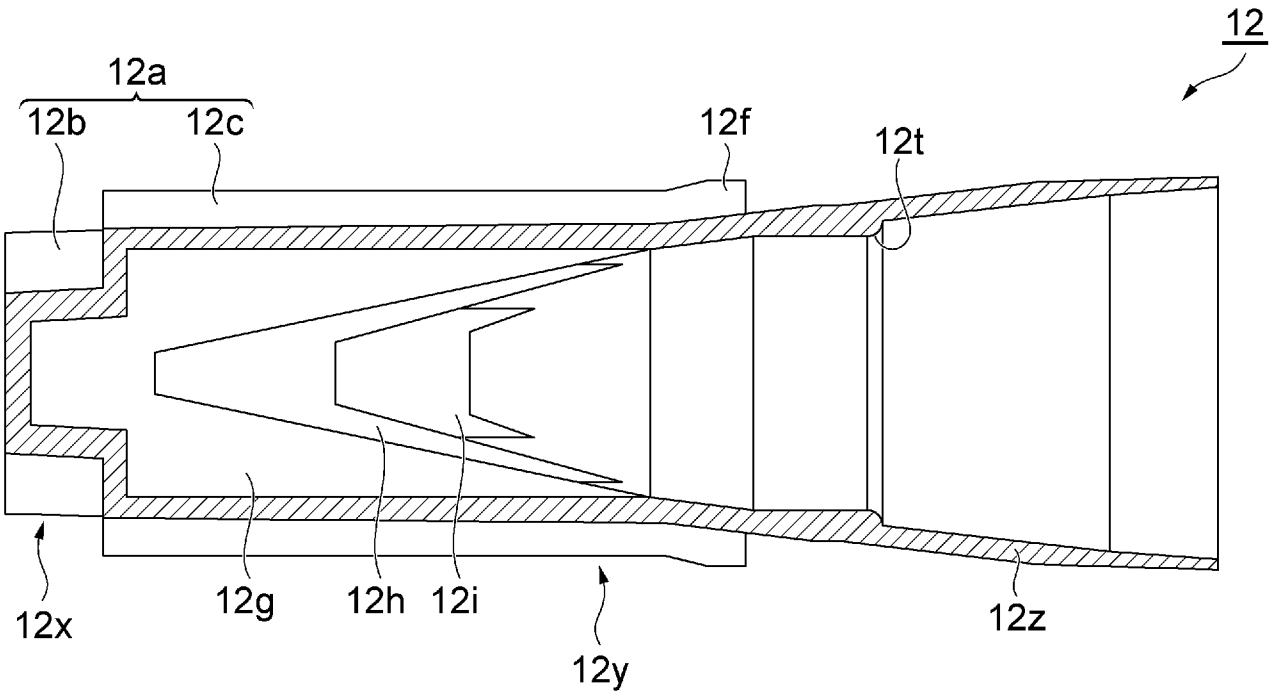
FIG. 10 is a view taken along a line X-X of FIG. 9 in the direction of the arrows.
Figure 11:
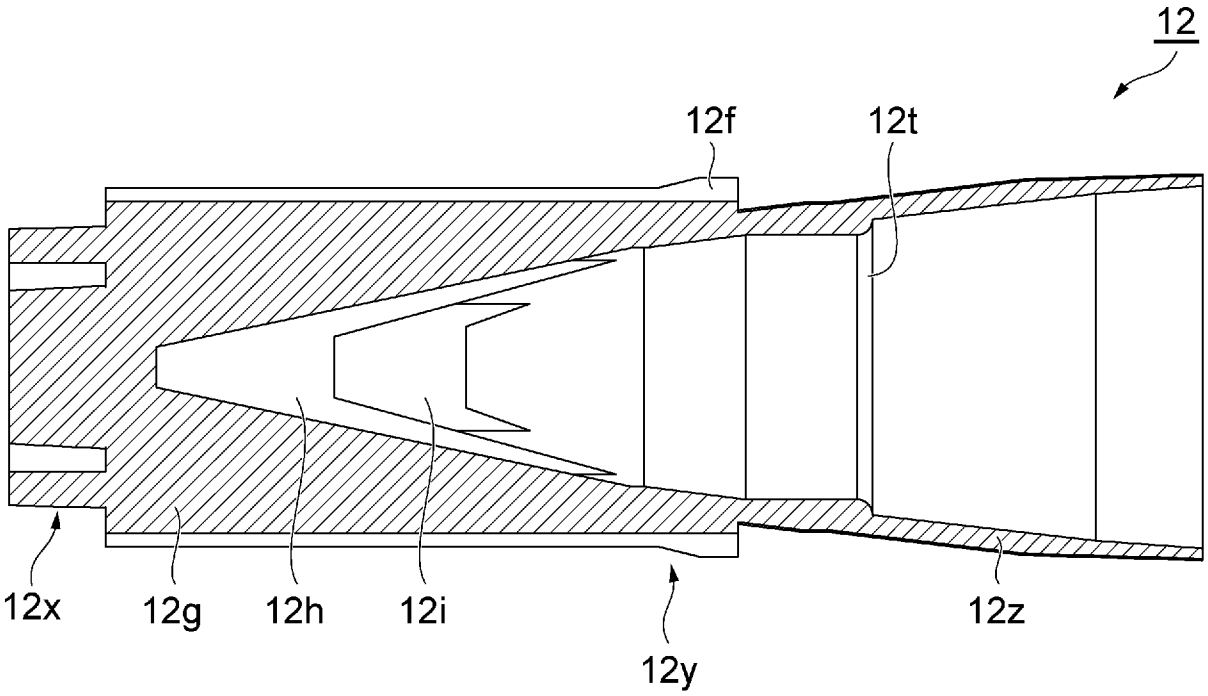
FIG. 11 is a view taken along a line XI-XI of FIG. 9 in the direction of the arrows.

FIG. 1 is an external view showing a liquid cosmetic material container provided with a container cap according to the first embodiment of the present disclosure. FIG. 2 is a longitudinal sectional view of FIG. 1. FIG. 3 is a longitudinal sectional view of the container cap. FIG. 4 is a view taken along a line IV-IV of FIG. 3 in the direction of the arrows. FIGS. 5 to 7 are each a perspective view of an inner cap. FIG. 8 is a sectional perspective view of the inner cap. FIG. 9 is a rear view of the inner cap. FIG. 10 is a view taken along a line X-X of FIG. 9 in the direction of the arrows. FIG. 11 is a view taken along a line XI-XI of FIG. 9 in the direction of the arrows. The liquid cosmetic material container according to the present embodiment can be used by a user to apply a liquid cosmetic material contained within the liquid cosmetic material container to a portion to which to apply the liquid cosmetic material as appropriate. The liquid cosmetic material in this case is particularly preferably an eyeliner cosmetic material including a volatile component. Hence, the liquid cosmetic material container is an eyeliner cosmetic material container.

As shown in FIG. 1 and FIG. 2, an eyeliner cosmetic material container 100 generally includes: a holding tube 1 to be held by the user at a time of use; a container main body 2 retained on the front end side of the holding tube 1; an application body 3 projecting from the front end of the container main body 2 to apply an eyeliner cosmetic material L within the container main body 2; and a container cap 10 detachably fitted to the front end side of the container main body 2 to cover the application body 3.

The holding tube 1 is formed for example of ABS (acrylonitrile-butadiene-styrene copolymer synthetic resin) or the like, and is formed in a bottomed cylindrical shape. The holding tube 1 is formed so as to be long in an axial direction so that the user easily applies the liquid cosmetic material while holding the holding tube 1.

The container main body 2 is formed for example of PP (polypropylene) or the like, and is formed in a cylindrical shape having a tapered surface 2*t* tapering off toward the front end side, as shown in FIG. 2. A housing portion 2*a* for housing the eyeliner cosmetic material L is formed within the container main body 2. Also housed within the container main body 2 are an application body holder 5 retaining the application body 3, a relay core 6 for supplying the eyeliner cosmetic material L to the application body 3, a bellows member 7 disposed so as to surround the relay core 6, and the like.

An annular flange portion 2*b* is provided on the outer circumferential surface of the front end side of the container main body 2. In addition, a convex portion 2*e* for fitting the container cap 10 is provided in an annular shape at a position in front of the flange portion 2*b* on the outer circumferential surface of the container main body 2. An opening at the rear end of the container main body 2 is closed by fitting a tail plug 8 formed for example of PP or the like into the container main body 2. An internal space formed so as to be increased in diameter in the rear of the bellows member 7 within the container main body 2 is the housing portion 2*a* filled with the eyeliner cosmetic material L. The housing portion 2*a* houses, together with the eyeliner cosmetic material L, a spherical agitator 9 formed for example of SUS (steel use stainless) or the like to agitate the eyeliner cosmetic material L.

Then, the container main body 2 is inserted from the rear end side thereof into the holding tube 1, and is fitted in the holding tube 1 detachably or undetachably in a state in which the flange portion 2*b* of the container main body 2 abuts against the front end surface of the holding tube 1.

The relay core 6 is formed for example of an acrylic resin or the like. The relay core 6 has the shape of a shaft body extending in the axial direction. A part on the rear end side of the relay core 6 advances into the housing portion 2*a*, and a part on the front end side of the relay core 6 advances into the application body 3. The relay core 6 thereby connects the inside of the housing portion 2*a* and the application body 3 to each other. The relay core 6 makes it possible to suck up the eyeliner cosmetic material L within the housing portion 2*a* and supply the eyeliner cosmetic material L to the application body 3 by capillarity.

The bellows member 7 is formed for example of PP or the like, and is configured in a substantially cylindrical shape. The relay core 6 is disposed inside the tube hole of the bellows member 7. The relay core 6 is fitted into a fitting portion 7*a* on the front end side of the bellows member 7. The bellows member 7 thereby retains the relay core 6. The bellows member 7 has bellows (groove) for containing the eyeliner cosmetic material L along the axial direction from the front end side to the rear end side. The flow rate of the eyeliner cosmetic material L supplied to the application body 3 via the relay core 6 is controlled to be an optimum by the bellows.

A cylindrical rear end portion 7*c* of the bellows member 7 is fitted to a concave portion 2*c* in the inner circumferential surface of the container main body 2. The bellows member 7 is thereby fitted to the container main body 2. In this state, the above-described housing portion 2*a* is formed between the rear end portion 7*c* of the bellows member 7 within the container main body 2 and the tail plug 8, and the eyeliner cosmetic material L is housed within the housing portion 2*a*.

The application body 3 is a brush in this case, and is formed by bundling filaments (hair) formed for example of PBT (polybutylene terephthalate) or the like. A rear end portion of the application body 3 is fixed to a disk-shaped application body retaining portion 3*a* having a through hole in a center thereof. The application body retaining portion 3*a* is sandwiched between the front end surface of the bellows member 7 and the rear end surface of the application body holder 5, and is thus not movable in the axial direction (to be described later in detail). In this state, the relay core 6 is inserted into the central through hole of the application body retaining portion 3*a*, and advanced into the application body 3.

The application body holder 5 is formed for example of PP or the like, and has a substantially cylindrical shape whose front end is tapered. The application body 3 passes through the tube hole of the application body holder 5. A part of the application body holder 5 excluding a front end portion of the application body holder 5 advances into a front end portion of the container main body 2. A flange portion 5*a* of a rear end portion of the application body holder 5 is positioned in the rear of a projecting portion 2*d* projecting to the inside of the front end portion of the container main body 2, and faces the projecting portion 2*d*.

When the bellows member 7 is inserted and fitted from the rear side of the container main body 2 into the container main body 2, the flange portion 5*a* of the application body holder 5 is pressed to the front end side in the axial direction via the application body retaining portion 3*a*, and abuts against the projecting portion 2*d* of the container main body 2. The application body holder 5 is thereby fitted so as not to be movable in the axial direction. Hence, the application body retaining portion 3*a* is rendered immovable in the axial direction by being sandwiched between the front end surface of the bellows member 7 and the rear end surface of the application body holder 5. The application body holder 5 adjusts the front end of the application body (brush) 3 into a sharp shape by bundling the application body 3 in such a manner as to hold the application body 3 from the periphery of the application body 3 by the tapered front end portion of the application body holder 5.

The container cap 10 is to protect the application body 3 and actively trap condensation (to be described later in detail). As shown in FIGS. 2 to 4, the container cap 10 includes an outer cap 11 forming an external shape and an inner cap (cap body) 12 housed in the outer cap 11.

The outer cap 11 is formed for example of PP or the like, functions as a housing cylinder housing the inner cap 12, and is configured in the shape of a bottomed cylinder. Convex portions 11*e* for engaging with the convex portion 2*e* of the container main body 2 in the axial direction are disposed at a plurality of positions (four positions arranged at equal intervals in this case) along a circumferential direction on an inner circumferential surface on the open end side of the outer cap 11 (the open end side of the cap will hereinafter be referred to as a rear end side, and the opposite side of the cap will hereinafter be referred to as a front end side). In addition, convex portions 11*f*, against which the inner cap 12 moving toward the rear end side of the outer cap 11 is abutted to be prevented from further movement when the container cap 10 is removed from the container main body 2, are disposed so as to project inward from positions closer to the front end side than the convex portions 11*e* on the inner circumferential surface of the outer cap 11. As shown in FIG. 4, the convex portions 11*f* are disposed at a plurality of positions (four positions arranged at equal intervals in this case) along the circumferential direction.

The inner cap 12 is formed for example of PP or the like, and is configured in the shape of a stepped bottomed cylinder, as shown in FIGS. 5 to 8. The inner cap 12 is to close the container. As shown in FIG. 5 and FIG. 6, the inner cap 12 includes a small-diameter portion 12*x*, a medium-diameter portion 12*y*, and a large-diameter portion 12*z* in this order from the front end side (left side in the figure).

The small-diameter portion 12*x* is formed in the shape of a short bottomed cylinder. The medium-diameter portion 12*y* is formed in the shape of a long cylinder increased in diameter and continuous with the cylindrical small-diameter portion 12*x*. A large number of convex portions 12*b* extending in the axial direction and forming the shape of a flat plate to actively promote heat radiation are juxtaposed to each other along the circumferential direction on the outer circumferential surface of the small-diameter portion 12*x* so as to face the axis of the inner cap 12. End surfaces on the outside in a radial direction of the convex portions 12*b* of the small-diameter portion 12*x* are substantially flush with the outer circumferential surface of the medium-diameter portion 12*y*. End surfaces on the rear end side of the convex portions 12*b* are connected to the front end surface of the medium-diameter portion 12*y*.

A large number of convex portions 12*c* extending so as to be long in the axial direction and forming the shape of a flat plate to actively promote heat radiation are juxtaposed to each other along the circumferential direction on the outer circumferential surface of the medium-diameter portion 12*y* so as to face the axis of the inner cap 12. The convex portions 12*c* of the medium-diameter portion 12*y* are provided so as to rise from positions where the convex portions 12*b* of the small-diameter portion 12*x* are connected to the end surface on the front end side of the medium-diameter portion 12*y*. As viewed from the side, the convex portions 12*c* of the medium-diameter portion 12*y* are provided so as to form continuous lines with the convex portions 12*b* of the small-diameter portion 12*x*.

Supposing that two of the convex portions 12*c* and 12*c* adjacent to each other in the circumferential direction are set as one set, end portions on the rear end side of the convex portions 12*c* and 12*c* of this set are coupled to each other by a block-shaped coupling portion 12*f* projected in the shape of an arc. On the other hand, a space extending in the axial direction is formed in a part between convex portions 12*c* and 12*c* adjacent to each other in the circumferential direction but not coupled to each other by a coupling portion 12*f*.

That is, in the present embodiment, a coupling portion 12*f*, a space, a coupling portion 12*f*, and a space are arranged alternately along the circumferential direction.

The convex portions 12*b* of the small-diameter portion 12*x* and the convex portions 12*c* of the medium-diameter portion 12*y* constitute a heat radiating portion 12*a*.

The large-diameter portion 12*z* assumes a shape that is gradually increased in diameter in the form of a trumpet toward the rear end side (right side in FIG. 5 and FIG. 6). As shown in FIG. 8, FIG. 10, and FIG. 11, a stepped portion 12*t* increased in diameter on the rear side is provided in an annular shape to the inner circumferential surface of the large-diameter portion 12*z*. As shown in FIG. 2, when the container cap 10 is fitted to the container main body 2, the stepped portion 12*t* is biased to the container main body 2 side (right side in the figure) by a compression coil spring 14 to be described later, and thus comes into airtightly close contact with the tapered surface 2*t* of the container main body 2.

In addition, as shown in FIGS. 7 to 11, the inner cap 12 has a plurality of flat plates (six plates in this case) juxtaposed to each other at substantially equal intervals within the small-diameter portion 12*x* and the medium-diameter portion 12*y* so as to extend through the extent of the small-diameter portion 12*x* and the medium-diameter portion 12*y*. The two central flat plates 12*g* and 12*g* have convex portions in the centers of end portions on the front end side (left side in FIG. 8) of the flat plates 12*g* and 12*g*, the convex portions advancing into the small-diameter portion 12*x*. The convex portions are connected to the inner surface of a front end portion (concave portion; the bottom portion of the bottomed cylindrical shape) of the small-diameter portion 12*x*. The end portions on the front end side of parts other than the convex portions of the flat plates 12*g* and 12*g* are connected to the front end portion of the medium-diameter portion 12*y*, and both side portions of the parts are connected to the inner circumferential surface of the medium-diameter portion 12*y*. As for flat plates 12*h* and 12*h* outward of the two central flat plates 12*g* and 12*g*, end portions on the front end side of the flat plates 12*h* and 12*h* are connected to the front end portion of the medium-diameter portion 12*y*, and both side portions of the flat plates 12*h* and 12*h* are connected to the inner circumferential surface of the medium-diameter portion 12*y*. As for flat plates 12*i* and 12*i* outward of these flat plates 12*h* and 12*h*, end portions on the front end side of the flat plates 12*i* and 12*i* are connected to the front end portion of the medium-diameter portion 12*y*, and both side portions of the flat plates 12*i* and 12*i* are connected to the inner circumferential surface of the medium-diameter portion 12*y*. Further, outer side surfaces of the flat plates 12*i* are connected to the inner circumferential surface of the medium-diameter portion 12*y*.

These flat plates 12*g* to 12*i* have shapes formed by notching central portions of rear end surfaces of the flat plates 12*g* to 12*i* toward the front end side, and have shapes that can come into proximity to the application body (brush) 3 when the container cap 10 is fitted to the container main body 2.

Specifically, the flat plates 12*g* to 12*i* have shapes formed by notching the central portions of the rear end surfaces of the flat plates 12*g* to 12*i* by such inclined planes as to form a taper (notching the central portions of the rear end surfaces of the flat plates 12*g* to 12*i* into a substantially trapezoidal shape). The central flat plates 12*g* have a shape notched greatly to the vicinity of the small-diameter portion 12*x*. The flat plates 12*h* outward of the central flat plates 12*g* have a shape notched to about the middle in the axial direction of the medium-diameter portion 12*y*. The flat plates 12*i* outward of the flat plates 12*h* have a shape notched least. In addition, as shown in FIG. 10 and FIG. 11, as viewed in a direction of the juxtaposition of the flat plates, the inclined surfaces of the flat plates 12*h* are positioned inward of the inclined surfaces of the central flat plates 12*g*, and the inclined surfaces of the flat plates 12*i* are located further inward of the inclined surfaces of the flat plates 12*h*.

As shown in FIGS. 7 to 9, concave portions 12*d* are formed between the flat plates 12*g* to 12*i*, and these juxtaposed concave portions 12*d* constitute a liquid trapping portion 12*k* for actively trapping liquids including condensation.

Incidentally, the width of the concave portions 12*d* is gradually decreased from the rear end side to the front end side due to a draft for extracting a core pin as a molding die rearward at a time of die molding.

In addition, as shown in FIG. 2 and FIG. 3, the container cap 10 according to the present embodiment has the compression coil spring 14 disposed between the front end surface of the convex portions 12*c* of the inner cap 12 and the inner surface of the front end portion of the outer cap 11. The compression coil spring 14 biases the inner cap 12 to the rear end side of the outer cap 11.

In a state in which the container cap 10 including the inner cap 12 and the outer cap 11 is fitted to the front end side of the container main body 2 as shown in FIG. 2, the convex portions 11*e* at the four positions of the outer cap 11 are positioned in the rear in the axial direction of the annular convex portion 2*e* of the container main body 2, and face the annular convex portion 2*e*. The fitted state is thus achieved.

In the state in which the container cap 10 is thus fitted to the container main body 2, the annular stepped portion 12*t* of the inner cap 12 is biased by the compression coil spring 14 to come into close contact (pressure contact) with the tapered surface 2*t* of the container main body 2. Thus, airtightness between the inner cap 12 and the container main body 2 is ensured to suppress volatilization of the eyeliner cosmetic material L.

In addition, in this state, a space whose rear end is opened and which extends in the axial direction is formed as a flow passage 13 between a part between convex portions 12*c* and 12*c* adjacent to each other in the circumferential direction but not coupled to each other by a coupling portion 12*f* (see FIG. 5 and FIG. 6) and the inner circumferential surface of the outer cap 11 (see FIG. 4).

When the container cap 10 is removed from the container main body 2 to use such an eyeliner cosmetic material container 100, as shown in FIG. 3, the biasing force of the compression coil spring 14 moves the inner cap 12 to the rear end side of the outer cap 11, and outer peripheral edges 12*p* as part of rear end surfaces of the coupling portions 12*f* of the inner cap 12 (see FIG. 4) abut against the convex portions 11*f* of the outer cap 11. The inner cap 12 is thereby prevented from further movement. In the container main body 2 shown in FIG. 2, the eyeliner cosmetic material L within the housing portion 2*a* is supplied to the application body 3 by the capillarity of the relay core 6 at all times. The user can therefore draw a desired line of eyeliner by the application body 3 while holding the holding tube 1 from which the container cap 10 is removed.

Then, after finishing the application, the user externally fits the container cap 10 onto the front end side of the container main body 2 to fit the container cap 10 to the container main body 2. The external fitting of the container cap 10 onto the front end side of the container main body 2 causes the annular stepped portion 12*t* of the inner cap 12 to abut against and come into close contact with the tapered surface 2*t* on the front end side of the container main body 2. Further external fitting moves the outer cap 11 to the container main body 2 side while the compression coil spring 14 is compressed. When the convex portions 11*e* at the four positions of the outer cap 11 then go over the annular convex portion 2*e* of the container main body 2 to the rear side in the axial direction, the container cap 10 (outer cap 11) is detachably fitted to the container main body 2, as shown in FIG. 1 and FIG. 2.

The eyeliner cosmetic material container 100 having the container cap 10 thus fitted to the container main body 2 produces the following action and effect when the temperature of an external environment is decreased, for example. The heat radiating portion 12*a* whose surface area is increased by the convex portions 12*b* and 12*c* provided on the external surface of the inner cap 12 as shown in FIG. 5 and FIG. 6 actively radiates heat of the external surface of the inner cap 12 and thus promotes cooling. Consequently, condensation forms on the inner surface of the inner cap 12 before condensation forms on the external surface of the container covered by the inner cap 12, or, in this case, the external surface on the front end side of the container main body 2 and the external surface of a part of the application body holder 5 which part projects from the container main body 2 (see FIG. 2). The condensed drops are trapped, by surface tension, in the concave portions 12*d* of the liquid trapping portion 12*k* provided on the inner surface of the inner cap 12, the concave portions 12*d* of the liquid trapping portion 12*k* being shown in FIGS. 7 to 9.

Thus, the eyeliner cosmetic material container 100 according to the present embodiment can prevent drops from adhering to the external surface of the container. Consequently, aesthetic appearance is not impaired, nor is the hand of the user soiled.

In addition, the inner cap 12 forms a bottomed tubular shape, and has the liquid trapping portion 12*k* on the inner circumferential surface of the inner cap 12 and has the heat radiating portion 12*a* on the outer circumferential surface of the inner cap 12. Thus, the heat radiating portion 12*a* provided on the wide region of the outer circumferential surface promotes heat radiation and cooling more, and the liquid trapping portion 12*k* provided on the wide region of the inner circumferential surface traps condensed drops more surely. As a result, the drops can be further prevented from adhering to the external surface of the container.

In addition, the width of the concave portions 12*d* of the liquid trapping portion 12*k* is gradually decreased from the rear end side to the front end side. Thus, the drops trapped by the concave portions 12*d* are collected easily and retained surely on the narrow front end side of the concave portions 12*d* due to capillarity. As a result, the drops can be further prevented from adhering to the external surface of the container.

In addition, because of the constitution having the outer cap 11 that houses the inner cap 12 of the bottomed tubular shape together with the convex portions 12*b* and 12*c* of the heat radiating portion 12*a*, the convex portions 12*b* and 12*c* on the external surface of the inner cap 12 are not obstructive, so that the user can easily hold the container cap 10 (outer cap 11) without any difficulty.

In addition, the constitution of the heat radiating portion 12*a* includes the plurality of convex portions 12*b* and 12*c* extending in the axial direction and juxtaposed to each other along the circumferential direction. Thus, heat can be radiated excellently, and molding using a die (die body) is performed easily.

In the state shown in FIG. 3 in which state the container cap 10 is removed from the container main body 2, a space between the outer circumferential surface of the rear end of the inner cap 12 and the inner circumferential surface of the outer cap 11 is not sealed, but there is a gap therebetween. Thus, the flow passages 13 shown in FIG. 4 have rear ends thereof opened and communicate with an external atmosphere. In the state shown in FIG. 2 in which state the container cap 10 is fitted to the container main body 2, on the other hand, the space between the outer circumferential surface of the rear end of the inner cap 12 and the inner circumferential surface of the outer cap 11 is not sealed but there is a gap therebetween, and also a space between the inner circumferential surface of a rear end portion of the outer cap 11 and the outer circumferential surface of the container main body 2 is not sealed but there is a gap therebetween. Consequently, the flow passages 13 shown in FIG. 4 have the rear ends thereof opened and communicate with the external atmosphere. That is, the flow passages 13 communicate with the external atmosphere at all times. The air (atmosphere) of the external atmosphere thus flows through the flow passages 13 along the axial direction to the front end side, so that the heat radiation by the heat radiating portion 12*a* is further promoted. Consequently, drops can be further prevented from adhering to the external surface of the container.

Incidentally, in the present embodiment, as shown in FIG. 5 and FIG. 6, supposing that convex portions 12*c* and 12*c* adjacent to each other in the circumferential direction are set as one set, the rear ends of the convex portions 12*c* and 12*c* of this set are coupled to each other by a coupling portion 12*f*, and the rear end of a part between the convex portions 12*c* and 12*c* coupled to each other by the coupling portion 12*f* does not communicate with the rear. However, it is also possible to further promote the heat radiation by the heat radiating portion 12*a* and thus further prevent drops from adhering to the external surface of the container by making the rear ends of parts between all of the convex portions 12*c* and 12*c* adjacent to each other in the circumferential direction communicate with the rear without providing the coupling portions 12*f*, and forming the flow passages 13 between the parts between all of the convex portions 12*c* and 12*c* adjacent to each other and the inner circumferential surface of the outer cap 11.

Figure 12:
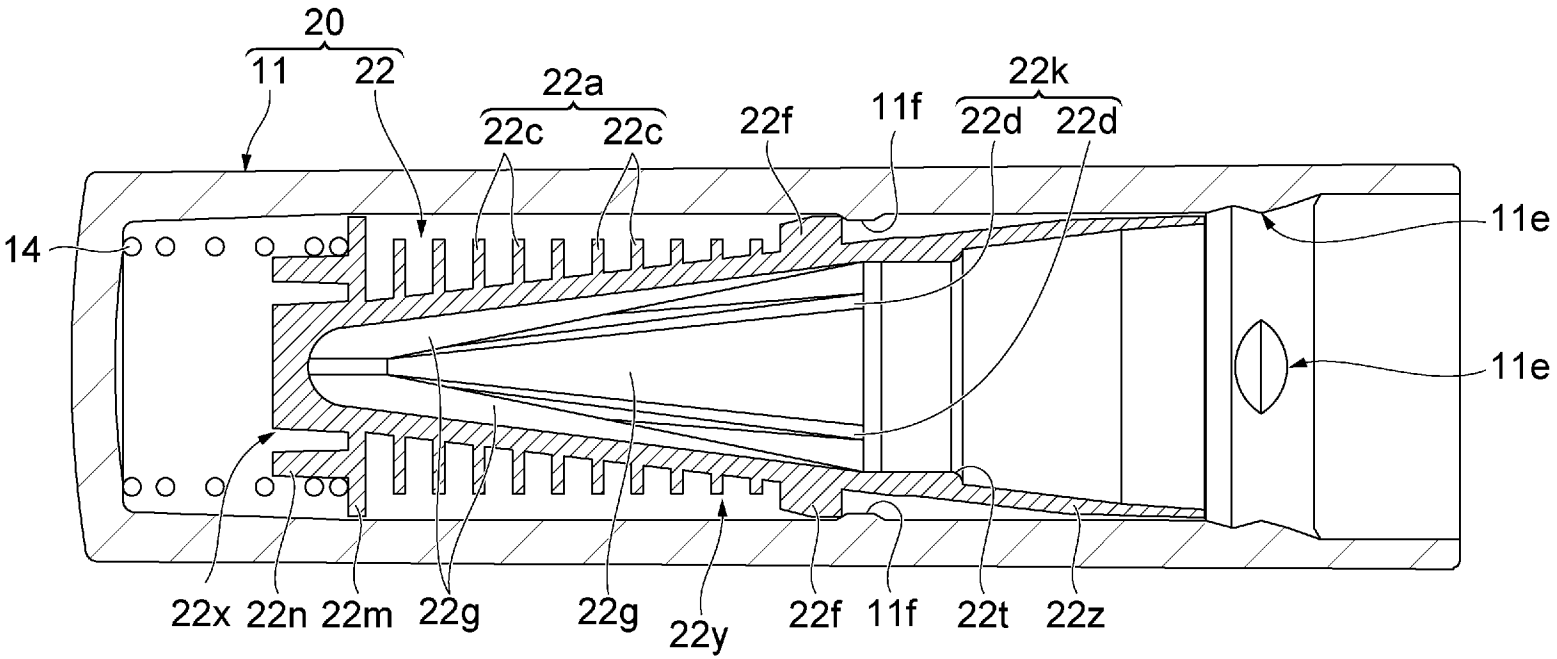
FIG. 12 is a longitudinal sectional view showing a container cap according to a second embodiment of the present disclosure.
Figure 13:
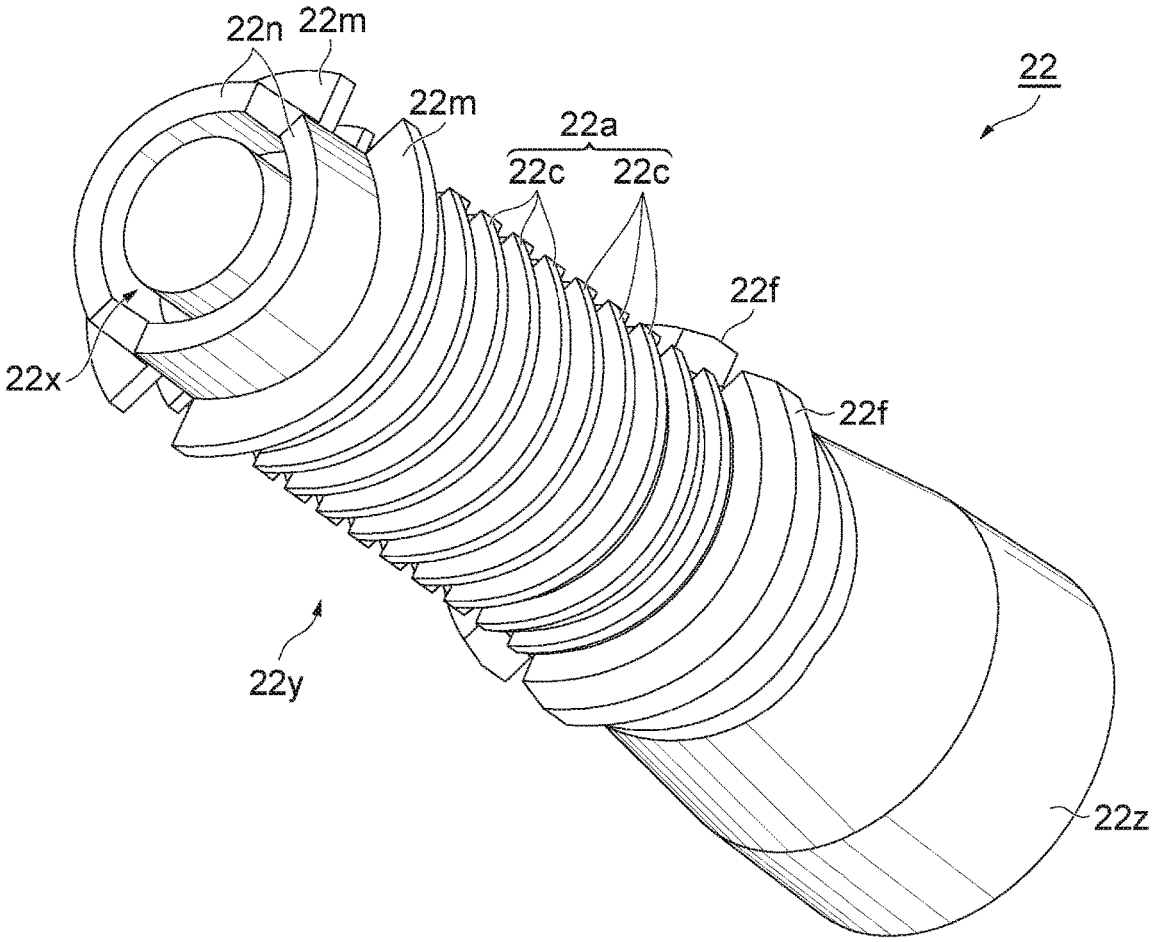
FIG. 13 is a front perspective view of an inner cap in FIG. 12.
Figure 14:
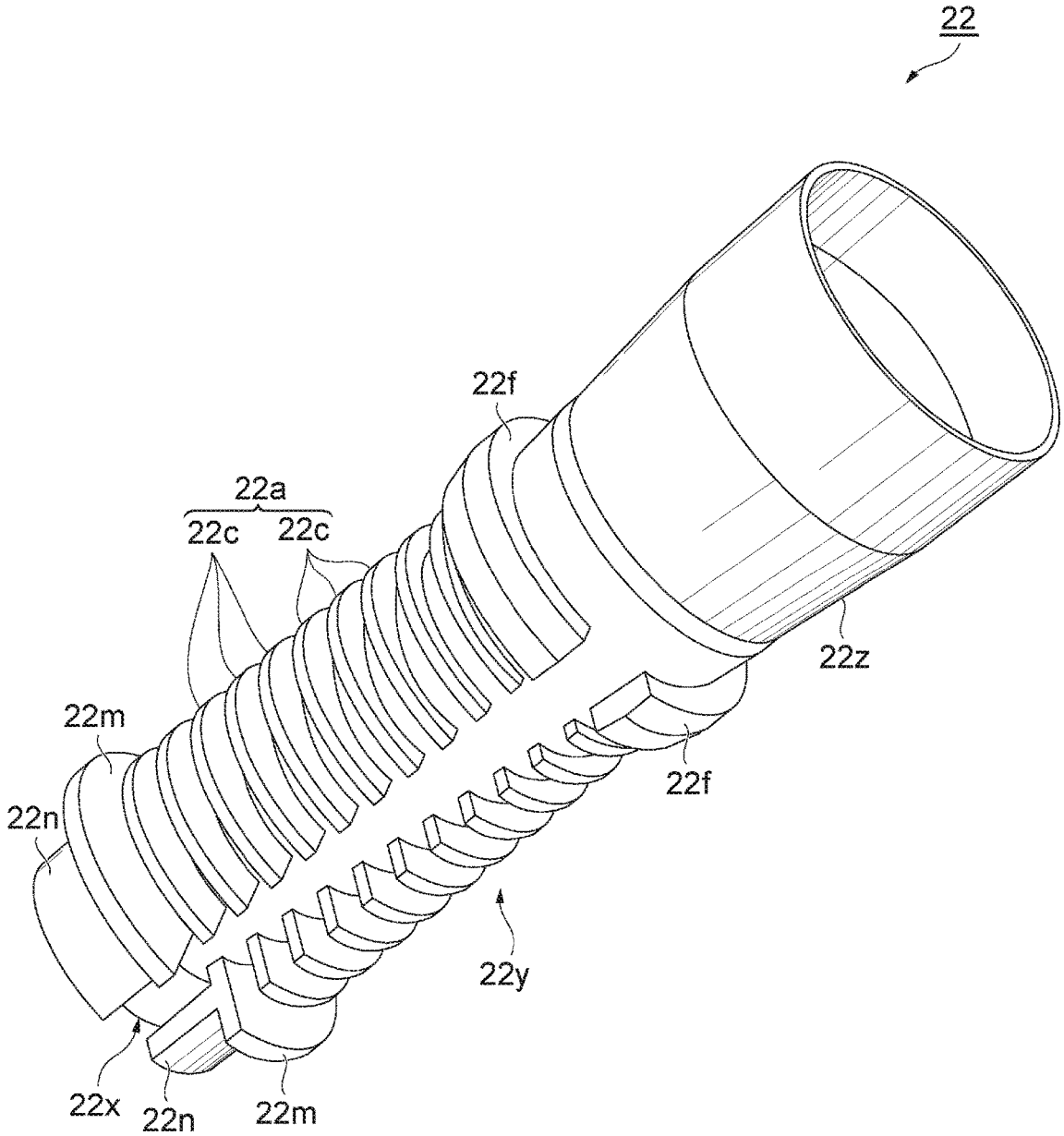
FIG. 14 is a rear perspective view of the inner cap shown in FIG. 13.
Figure 15:
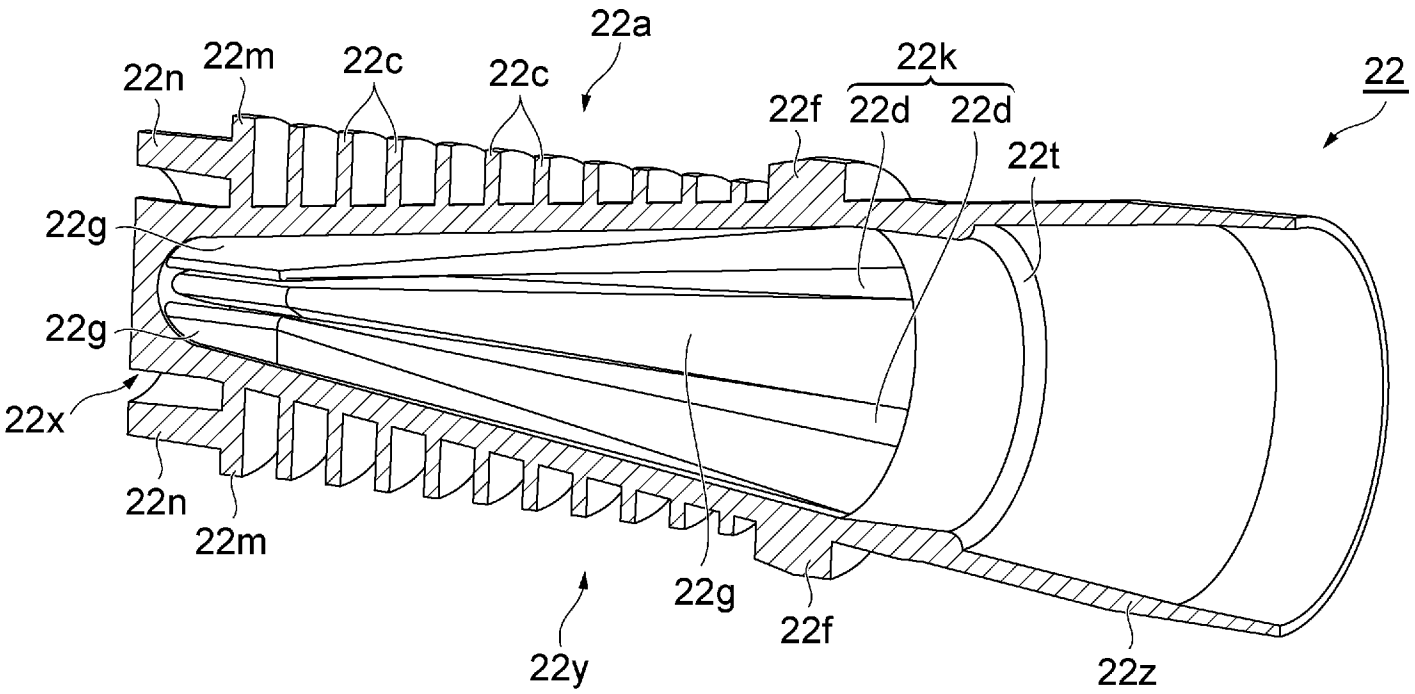
FIG. 15 is a sectional perspective view of the inner cap shown in FIG. 14.

FIG. 12 is a longitudinal sectional view showing a container cap according to a second embodiment of the present disclosure. FIG. 13 and FIG. 14 are each a perspective view of an inner cap. FIG. 15 is a sectional perspective view of the inner cap.

A container cap 20 according to the second embodiment is different from the container cap 10 according to the first embodiment in that the inner cap 12 of the first embodiment is replaced with an inner cap 22, or specifically in that the heat radiating portion 12*a* including the convex portions 12*b* and 12*c* extending in the axial direction in the first embodiment is replaced with a heat radiating portion 22*a* including convex portions 22*c* extending in the shape of an arc in a circumferential direction.

The inner cap 22 will be explained in detail in the following.

As shown in FIGS. 12 to 15, the inner cap 22 includes a small-diameter portion 22*x*, a medium-diameter portion 22*y*, and a large-diameter portion 22*z* in this order from a front end side.

The small-diameter portion 22*x* is formed in a short bottomed cylindrical shape. Provided at a rear end of the small-diameter portion 22*x* is a pair of spring receivers 22*m* opposed to each other along the circumferential direction, the spring receivers 22*m* being projected so as to form the shape of an arc as viewed in an axial direction and extend in a radial direction. The spring receivers 22*m* are to receive a compression coil spring 14 in the axial direction. The front end surfaces of the spring receivers 22*m* are each provided with a spring guide 22*n* that forms the shape of an arc as viewed in the axial direction and which extends in the axial direction. The spring guides 22*n* are to guide the compression coil spring 14 in the radial direction in a state of being surrounded by the compression coil spring 14. The spring receivers 22*m* and the spring guides 22*n* serve also as a heat radiating portion.

The medium-diameter portion 22*y* is a tubular portion continuous with the cylindrical small-diameter portion 22*x* in such a manner as to increase in diameter in a tapered shape. A pair of convex portions 22*c* projected so as to form the shape of an arc as viewed in the axial direction and extend in the radial direction to actively promote heat radiation is provided so as to be opposed to each other along the circumferential direction on the outer circumferential surface of the medium-diameter portion 22*y*. A large number of convex portions 22*c* are juxtaposed to each other along the axial direction. The projection length in the radial direction of the convex portions 22*c* is gradually decreased from the front end side to the rear end side. The convex portions 22*c* have a substantially identical height as viewed in the axial direction. In addition, gaps between the convex portions 22*c* and 22*c* arranged in the circumferential direction are positioned so as to be arranged in line along the axial direction. The convex portions 22*c* juxtaposed to each other along the axial direction constitute the heat radiating portion 22*a*.

In addition, convex portions 22*f* projected so as to form the shape of an arc as viewed in the axial direction and extend in the radial direction are provided on a rear end portion of the medium-diameter portion 22*y* to exert a function similar to that of the coupling portions 12*f* in the foregoing first embodiment. The convex portions 22*f* serve also as a heat radiating portion. The positions of gaps between the convex portions 22*f* and 22*f* arranged in the circumferential direction, the positions of gaps between the convex portions 22*c* and 22*c* arranged in the circumferential direction, the positions of gaps between the spring receivers 22*m* and 22*m*, and the positions of gaps between the spring guides 22*n* and 22*n* are arranged in line along the axial direction. The gaps form spaces extending in the axial direction (see FIG. 14). The spaces constitute flow passages 13 to be described later.

The large-diameter portion 22*z* has a shape similar to that of the large-diameter portion 12*z* in the first embodiment, that is, has a shape gradually increased in diameter in the shape of a trumpet toward the rear end side. As shown in FIG. 12 and FIG. 15, an annular stepped portion 22*t* increased in diameter on the rear side is provided to the inner circumferential surface of the large-diameter portion 22*z*, the annular stepped portion 22*t* being to be brought into airtightly close contact with the tapered surface 2*t* of the container main body 2.

In addition, as shown in FIG. 12 and FIG. 15, a plurality of convex portions 22*g* projecting inward and extending in the axial direction through the extent of the small-diameter portion 22*x* and the medium-diameter portion 22*y* are juxtaposed to each other along the circumferential direction on the inside of the inner cap 22. The convex portions 22*g* have shapes that can come into proximity to the application body (brush) 3 when the container cap 20 is fitted to the container main body 2.

Specifically, the convex portions 22*g* extend in the axial direction from a front end portion of the small-diameter portion 22*x*, and have an identical projection length up to about a position beyond the small-diameter portion 22*x*. The projection length of the convex portions 22*g* in the medium-diameter portion 22*y* is gradually decreased toward the rear end side, and the width of the convex portions 22*g* in the medium-diameter portion 22*y* is gradually increased toward the rear end side.

Concave portions 22*d* are formed between the convex portions 22*g* and 22*g*. The width of these concave portions 22*d* is gradually decreased from the rear end side to the front end side. Hence, due to such a draft gradually narrowed from the rear end side to the front end side, a core pin as a molding die can be easily extracted rearward at a time of die molding. The concave portions 22*d* juxtaposed to each other in the circumferential direction constitute a liquid trapping portion 22*k* for actively trapping liquids including condensation.

Incidentally, an outer cap 11 is similar to that of the first embodiment, and an eyeliner cosmetic material container to which to apply the container cap 20 including the outer cap 11 and the inner cap 22 is also similar to that of the first embodiment.

The thus formed container cap 20 produces action and effect substantially similar to those of the container cap 10 according to the first embodiment.

Specifically, according to the present embodiment, the heat radiating portion 22*a* whose surface area is increased by the convex portions 22*c* provided on the external surface of the inner cap 22 as shown in FIG. 13 and FIG. 14 actively radiates heat of the external surface of the inner cap 22 and thus promotes cooling. Consequently, condensation forms on the inner surface of the inner cap 22 before condensation forms on the external surface of the container covered by the inner cap 22 (the external surface on the front end side of the container main body 2 and the external surface of a part of the application body holder 5 which part projects from the container main body 2; see FIG. 2). The condensed drops are trapped, by surface tension, in the concave portions 22*d* of the liquid trapping portion 22*k* provided on the inner surface of the inner cap 22, the concave portions 22*d* of the liquid trapping portion 22*k* being shown in FIG. 12 and FIG. 15. Hence, the drops can be prevented from adhering to the external surface of the container, so that aesthetic appearance is not impaired, nor is the hand of the user soiled.

In addition, the inner cap 22 forms a bottomed tubular shape, and has the liquid trapping portion 22*k* on the inner circumferential surface of the inner cap 22 and has the heat radiating portion 22*a* on the outer circumferential surface of the inner cap 22. Thus, the heat radiating portion 22*a* provided on the wide region of the outer circumferential surface promotes heat radiation and cooling more, and the liquid trapping portion 22*k* provided on the wide region of the inner circumferential surface traps condensed drops more surely. As a result, the drops can be further prevented from adhering to the external surface of the container.

In addition, the width of the concave portions 22*d* of the liquid trapping portion 22*k* is decreased from the rear end side to the front end side. Thus, the drops trapped by the concave portions 22*d* are collected easily and retained surely on the narrow front end side of the concave portions 22*d* due to capillarity. As a result, the drops can be further prevented from adhering to the external surface of the container.

In addition, because the container cap 20 includes the outer cap 11 similar to that of the first embodiment, which outer cap houses the inner cap 22 of the bottomed tubular shape together with the convex portions 22*c* and 22*c* of the heat radiating portion 22*a*, the convex portions 22*c* and 22*c* on the external surface of the inner cap 22 are not obstructive, so that the user can easily hold the container cap 20 (outer cap 11) without any difficulty.

In addition, a plurality of arc-shaped convex portions 22*c* (pair of arc-shaped convex portions 22*c* in this case) of the inner cap 22 are provided along the circumferential direction. Spaces extending in the axial direction are formed as flow passages 13 (see FIG. 4 of the first embodiment) between the inner circumferential surface of the outer cap 11 and parts between the arc-shaped convex portions 22*c* and 22*c* in the circumferential direction on the outer circumferential surface of the inner cap 22. As described in the first embodiment, the flow passages 13 have a rear end thereof opened, and communicate with an external atmosphere. The air of the external atmosphere thus flows through the flow passages 13 along the axial direction to the front end side, and flows between the large number of arc-shaped convex portions 22*c* and 22*c* juxtaposed to each other along the axial direction. As a result, the heat radiation by the heat radiating portion 22*a* is further promoted. Accordingly, the drops can be further prevented from adhering to the external surface of the container.

Incidentally, in the present embodiment, as a particularly preferable example, the heat radiating portion 22*a* is constituted of the arc-shaped convex portions 22*c*, and a plurality of convex portions 22*c* are juxtaposed to each other along the circumferential direction, to thereby form a plurality of flow passages 13 for circulating the air of the external atmosphere in the axial direction, the flow passages 13 being similar to those of the first embodiment (see FIG. 4). However, the heat radiating portion 22*a* can also be constituted of annular convex portions. In addition, one part of the annular convex portions may be cut off, and the convex portions extending in the circumferential direction so as to form substantially the shape of a C as viewed in the axial direction may be formed as a heat radiating portion. Even in such a constitution, a space extending in the axial direction which space is similar to the above-described spaces is formed as a flow passage between the inner circumferential surface of the outer cap 11 and parts between ends in the circumferential direction of the substantially C-shaped convex portions on the outer circumferential surface of the inner cap 22. The air of the external atmosphere thus flows through the flow passage in the axial direction. Consequently, the heat radiation by the heat radiating portion can be further promoted.

The present disclosure has been described above concretely on the basis of embodiments thereof. However, the present disclosure is not limited to the foregoing embodiments. For example, in the foregoing embodiments, as a particularly suitable example, the convex portions 12*b*, 12*c*, and 22*c* constituting the heat radiating portions 12*a* and 22*a* are provided on the outer circumferential surfaces of the inner caps 12 and 22 of a bottomed tubular shape, and the concave portions 12*d* and 22*d* constituting the liquid trapping portions 12*k* and 22*k* are provided on the inner circumferential surfaces of the inner caps 12 and 22. However, the heat radiating portions 12*a* and 22*a* and the liquid trapping portions 12*k* and 22*k* may be provided to the front end portion of the bottomed tubular shape.

In addition, in the foregoing embodiments, as a particularly preferable example, a plurality of concave portions 12*d* and 22*d* are provided as the liquid trapping portions 12*k* and 22*k*, and a plurality of convex portions 12*b*, 12*c*, and 22*c* are provided as the heat radiating portions 12*a* and 22*a*. However, the concave portions 12*d* and 22*d* constituting the liquid trapping portions 12*k* and 22*k* and the convex portions 12*b*, 12*c*, and 22*c* constituting the heat radiating portions 12*a* and 22*a* can be for example one spiral concave portion and one spiral convex portion, respectively.

In addition, the eyeliner cosmetic material containers 100 according to the foregoing embodiments may be provided with an extruding mechanism such for example as a pressurizing piston for extruding the eyeliner cosmetic material L to the front end side, and the extruding mechanism may be used as an aid for moving the eyeliner cosmetic material L to the front end side. The present disclosure is also applicable to eyeliner cosmetic material containers of a squeeze type such as a tube, a soft bottle, or the like that allows the eyeliner cosmetic material L to be squeezed out by a pressing force of the user.

In addition, in the foregoing embodiments, as a particularly preferable example, the liquid cosmetic material is the eyeliner cosmetic material L, and the container is the eyeliner cosmetic material container 100. However, the liquid may be another liquid cosmetic material such for example as eyebrow mascara, hair mascara, or the like, and the container may be another liquid cosmetic material container. Further, the liquid cosmetic material can be replaced with an ink for a writing instrument or the like, a glue, or a liquid medicine, and the container can be a liquid container. In short, the present disclosure is suitably applied to liquid containers containing a liquid including a volatile component. In addition, without being limited to liquids, the present disclosure is also applicable to containers containing for example a gel or the like including a volatile component such for example as water. In short, the present disclosure is suitably applied to containers containing contents including a volatile component. In this case, the contents may be fixed without being squeezed out or being drawn out. Further, in the foregoing embodiments, the outer cap 11 as a housing cylinder and the inner cap 12 (22) as a cap body have a bottomed tubular shape. However, for example, the cap body can be a flat plate-shaped inner cap, and the flat plate-shaped inner cap can be covered from the outside by an outer cap having a flat external surface. In this case, it suffices to provide concave portions constituting a liquid trapping portion on the inner surface of the flat plate-shaped inner cap, provide convex portions constituting a heat radiating portion on the outer surface of the flat plate-shaped inner cap, and cover the heat radiating portion of the inner cap with the outer cap having the flat external surface. In this case, the outer cap may not be provided.

Incidentally, when liquid including liquid cosmetic materials as contents has low viscosity, the liquid within the container may accidentally leak out from a discharge port of the container. However, the liquid thus leaking out is actively trapped in the concave portions of the liquid trapping portion of the cap body by surface tension. Hence, the liquid (drops) can be prevented from adhering to the external surface of the container. As a result, aesthetic appearance is not impaired, nor is the hand of the user soiled.

What is claimed is:

1. A container cap fitted to a container having contents, the container cap comprising:

an outer cap; and an inner cap housed within the outer cap, configured to close the container by covering a part of the container, the inner cap including a small-diameter portion at a front end side of the inner cap, a medium-diameter portion having a tapered shape of increasing diameter toward a rear end side of the inner cap and continuous with and distal of the small-diameter portion, and a large-diameter portion continuous with and distal of the medium-diameter portion at the rear end side of the inner cap, a liquid trapping portion including a plurality of concave portions alternating with a plurality of convex portions, disposed on and extending along a long axis of an inner surface of the medium-diameter portion of the inner cap, the inner surface being a surface on a side covering the container, the plurality of concave portions tapered to have a width that gradually decreases from the rear end side of the inner cap to the front end side of the inner cap, each of the concave portions of the liquid trapping portion including a closed bottom portion recessed radially outward from the inner surface of the inner cap toward the outer surface of the inner cap, an annular stepped portion of increased diameter provided around an inner circumference of the large-diameter portion, and a heat radiating portion including a plurality of convex portions disposed on an external surface of the inner cap, the concave portions on the inner surface of the inner cap having the closed bottom forming an enclosed space between the liquid trapping portion and the container when the inner cap is fitted to the container.

2. The container cap according to claim 1, wherein the inner cap forms a bottomed tubular shape, and has the liquid trapping portion on an inner circumferential surface of the inner cap and has the heat radiating portion on an outer circumferential surface of the inner cap.

3. The container cap according to claim 2, wherein the outer cap housing the inner cap also houses the convex portions of the heat radiating portion.

4. The container cap according to claim 1, wherein the outer cap housing the inner cap also houses the convex portions of the heat radiating portion.

5. The container cap according to claim 3, wherein the plurality of convex portions of the heat radiating portion are provided along a circumferential direction, a space extending in an axial direction is formed as a flow passage between an inner circumferential surface of the outer cap and a part between the convex portions of the heat radiating portion on the outer circumferential surface of the inner cap, and a rear end of the flow passage is opened and the flow passage communicates with an external atmosphere.

6. The container cap according to claim 4, wherein the plurality of convex portions of the heat radiating portion are provided along a circumferential direction, a space extending in an axial direction is formed as a flow passage between an inner circumferential surface of the outer cap and a part between the convex portions of the heat radiating portion on an outer circumferential surface of the inner cap, and a rear end of the flow passage is opened and the flow passage communicates with an external atmosphere.

7. The container cap according to claim 3, wherein the convex portions of the heat radiating portion are disposed so as to extend in a circumferential direction, a space extending in an axial direction is formed as a flow passage between an inner circumferential surface of the outer cap and a part between ends in the circumferential direction of the convex portions of the heat radiating portion on the outer circumferential surface of the inner cap, and a rear end of the flow passage is opened and the flow passage communicates with an external atmosphere.

8. The container cap according to claim 4, wherein the convex portions of the heat radiating portion are disposed so as to extend in a circumferential direction, a space extending in an axial direction is formed as a flow passage between an inner circumferential surface of the outer cap and a part between ends in the circumferential direction of the convex portions of the heat radiating portion on an outer circumferential surface of the inner cap, and a rear end of the flow passage is opened and the flow passage communicates with an external atmosphere.

* * * * *